US007523618B2

(12) United States Patent
Tanaka

(10) Patent No.: US 7,523,618 B2
(45) Date of Patent: Apr. 28, 2009

(54) CRYO PUMP

(75) Inventor: Hidekazu Tanaka, Tokorozawa (JP)

(73) Assignee: Sumitomo Heavy Industries, Ltd., Tokyo (JP)

( * ) Notice: Subject to any disclaimer, the term of this patent is extended or adjusted under 35 U.S.C. 154(b) by 466 days.

(21) Appl. No.: 10/576,014

(22) PCT Filed: Nov. 17, 2004

(86) PCT No.: PCT/JP2004/017052

§ 371 (c)(1),
(2), (4) Date: Apr. 17, 2006

(87) PCT Pub. No.: WO2005/050018

PCT Pub. Date: Jun. 2, 2005

(65) Prior Publication Data

US 2007/0144185 A1 Jun. 28, 2007

(30) Foreign Application Priority Data

Nov. 20, 2003 (JP) ..... 2003-391158

(51) Int. Cl.
*B01D 8/00* (2006.01)

(52) U.S. Cl. ..... 62/55.5

(58) Field of Classification Search ..... 62/55.5
See application file for complete search history.

(56) References Cited

U.S. PATENT DOCUMENTS

| | | | | |
|---|---|---|---|---|
| 3,390,536 | A * | 7/1968 | Kreisman | 62/55.5 |
| 3,579,998 | A * | 5/1971 | Thibault et al. | 62/55.5 |
| 4,611,467 | A * | 9/1986 | Peterson | 62/55.5 |
| 4,910,965 | A * | 3/1990 | Lepofsky et al. | 62/55.5 |
| 5,343,709 | A * | 9/1994 | Kohler | 62/55.5 |
| 6,155,059 | A * | 12/2000 | Matte et al. | 62/55.5 |

FOREIGN PATENT DOCUMENTS

| | | | |
|---|---|---|---|
| JP | 60-222572 | A | 11/1985 |
| JP | 07-507855 | A | 8/1995 |

* cited by examiner

*Primary Examiner*—William C Doerrler
(74) *Attorney, Agent, or Firm*—Rader, Fishman & Grauer, PLLC

(57) ABSTRACT

In a cryo pump 20 that is used in a process chamber 10 into which a process gas is introduced and that includes a first-stage panel, a heat shield plate 24, and a second-stage panel 28, a notch for allowing for entrance of gas molecules and an additional shield 34 for preventing entrance of heat due to radiation from a room-temperature cryo pump chamber are provided in the heat shield plate 24. Thus, lowering of a performance of the cryo pump caused by the process gas getting between the cryo pump chamber and the heat shield plate can be prevented.

9 Claims, 6 Drawing Sheets

PRIOR ART

CRYO PUMP

TECHNICAL FIELD

The present invention relates to a cryo pump. More particularly, the present invention relates to a cryo pump that is suitable for use in a sputtering apparatus and a semiconductor manufacturing apparatus, is used in a process chamber into which a process gas is introduced, and includes a heat shield plate.

BACKGROUND ART

Sputtering is performed in a process chamber that is a vacuum chamber. In order to perform sputtering, a mechanical rotary pump is first operated to form a rough vacuum of 1 Pa and thereafter a cryo pump described in Japanese Patent Laid-Open Publication No. Hei 5-321832 is operated to form a high vacuum of about $10^{-7}$ Pa. Then, a process gas such as Ar or $N_2$ is introduced in order to perform sputtering. A surplus part of the process gas is condensed in the cryo pump with progress of the operation, thus lowering a performance of the cryo pump.

In other words, the cryo pump condenses the surplus part of the process gas in a conventional technique. The process gas gets between a pump chamber and a heat shield plate because of a structure of the cryo pump. In the process gas between the room-temperature cryo pump chamber and the heat shield plate, gas molecules transfer heat from a room temperature, thus raising a temperature of the heat shield plate and lowering a refrigerating capacity and a condensing performance.

An exemplary conventional technique using a horizontal refrigerator is described in detail with reference to FIG. 1.

A vacuum chamber 10 serving as a process chamber is connected to a coarse vacuum pump 12 that is a mechanical rotary pump, a cryo pump 20, and a process gas introduction port 14 and is formed to be airtight. Target 16 and wafer 18 are arranged inside the vacuum chamber 10 in order to perform a process such as sputtering. Sputtering is performed in the process chamber 10.

A manner of the process is now described.

(1) The coarse vacuum pump 12 is operated to coarsely draw a vacuum of 1 Pa.

If a vacuum level is not higher than a certain level, the amount of heat entering from a room temperature is large because of heat transfer by gas molecules. Therefore, the cryo pump 20 cannot perform refrigeration. Moreover, the cryo pump 20 does not work well because too many gas molecules (in particular, $H_2O$) or the like adhere to the cryo pump 20. Thus, it is always necessary to draw a vacuum by using a mechanical pump. Furthermore, in order to achieve a high vacuum only by the mechanical rotary pump, a load applied to the pump is large because the pump should be rotated at a high speed, for example. From a viewpoint of reliability during a long operation, the long operation in a high vacuum state requires the cryo pump 20.

(2) Then, the cryo pump 20 is operated so as to form a high vacuum of about $10^{-7}$ Pa inside the process chamber 10.

The cryo pump 20 refrigerates a louver 26, a cryo panel (that is also called as a second-stage panel because it is connected to a second (refrigerating) stage 22) 28, and the like to a solidification temperature of gas molecules or less, thus causing condensation and solidification of gas molecules on those components or absorption of gas molecules because of cooling of activated carbon. In this manner, the cryo pump 20 forms a high vacuum. An operation of the horizontal refrigerator 30 forming the cryo pump 20 is suitable for a long high-vacuum operation with high reliability, because an applied load is lower than that applied to a mechanical pump.

(3) A process gas such as Ar or $N_2$ is introduced from the process gas introduction port 14 in order to perform sputtering.

A two-stage GM (Gifford-McMahon type) refrigerator 30 is usually used in the cryo pump 20. A high-temperature first (refrigerating) stage 21 includes a heat shield plate 24 covering a second (refrigerating) stage 22. The heat shield plate 24 is provided for shielding radiated heat from a room temperature, suppresses entrance of heat to the second stage 22, and improves a refrigerating capability. A louver 26 or the like is provided at a top end of the heat shield plate 24, thereby forming an entrance for gas molecules. The louver 26 condenses gas molecules having a relatively higher solidification temperature ($H_2O$ in particular), for example, because it is cooled by the heat shield plate 24. Moreover, the second stage 22 is cooled to about 10 K. Thus, the second stage 22 condenses hydrogen, oxygen, nitrogen, and the like. The second stage 22 also cools activated carbon contained as absorbent in a cryo panel 28, thereby causing absorption of a gas into fine holes in the activated carbon.

However, in the above process, the process gas such as Ar or $N_2$ enters in a shield chamber space 25 between the vacuum chamber 10 and the heat shield plate 24, as shown with Arrow A. Gas molecules in the entering process gas transfer heat from a room temperature to the heat shield plate 24, thus raising a temperature of the heat shield plate 24, and lowering the refrigerating capability and the condensing performance of the second stage 22.

Japanese Patent Laid-Open Publication No. Sho 60-228779 describes that, in order to prevent the gas from getting between the vacuum chamber and the heat shield plate, a rib or a flange is provided to make the space narrower or a heat insulating panel is provided to close the entrance for the gas.

DISCLOSURE OF THE INVENTION

In this case, however, the structure becomes complicated. Moreover, when the cryo panel is brought into contact with the heat shield plate, it is difficult to prevent heat transfer, and increasing a cost.

According to the present invention, a cryo pump includes: a cryogenic refrigerator; a first-stage panel and a heat shield plate that are cooled in a first stage of the cryogenic refrigerator; and a second-stage panel that is surrounded in the heat shield plate, is cooled by a second stage of the cryogenic refrigerator, and has an absorbent. The cryo pump further includes a notch, provided in the heat shield plate, for allowing for entrance of gas molecules; and an additional shield for preventing entrance of heat due to radiation from a room-temperature cryo pump chamber to the second-stage panel.

The notch and the additional shield may be positioned on the heat shield plate surrounding the second-stage panel therein.

The additional shield may be supported by the heat shield plate via an additional shield supporting member.

The refrigerator may be a horizontal type and the additional shield may have a C-shaped cross section in which a portion corresponding to the refrigerator is cut.

The additional shield may be formed in such a manner that a portion thereof having a C-shaped cross section has a length covering the second-stage panel.

The refrigerator may be a horizontal type or a vertical type and the additional shield may be tubular.

The additional shield may be a concave or convex portion provided on the heat shield plate, and an opening for allowing for entrance of gas molecules may be provided on a side face of the concave or convex portion.

Moreover, the present invention provides a sputtering apparatus or a semiconductor manufacturing apparatus that includes the aforementioned cryo pump.

According to the present invention, a process gas getting between a process chamber and a heat shield plate enters the inside of the heat shield plate, and is condensed and becomes solidified on a second-stage panel or is absorbed by an absorbent such as activated carbon. Thus, gas molecules in the process gas do not transfer heat from a room temperature to the heat shield plate. Therefore, a temperature of the heat shield plate is not increased, a refrigerating capability of a refrigerator is not lowered, and a condensing performance is not affected. Moreover, radiated heat does not affect a cryo pump chamber, in particular, the second-stage panel.

BEST MODE FOR CARRYING OUT THE INVENTION

Embodiments of the present invention are now described in detail with reference to the drawings.

Figure 1:
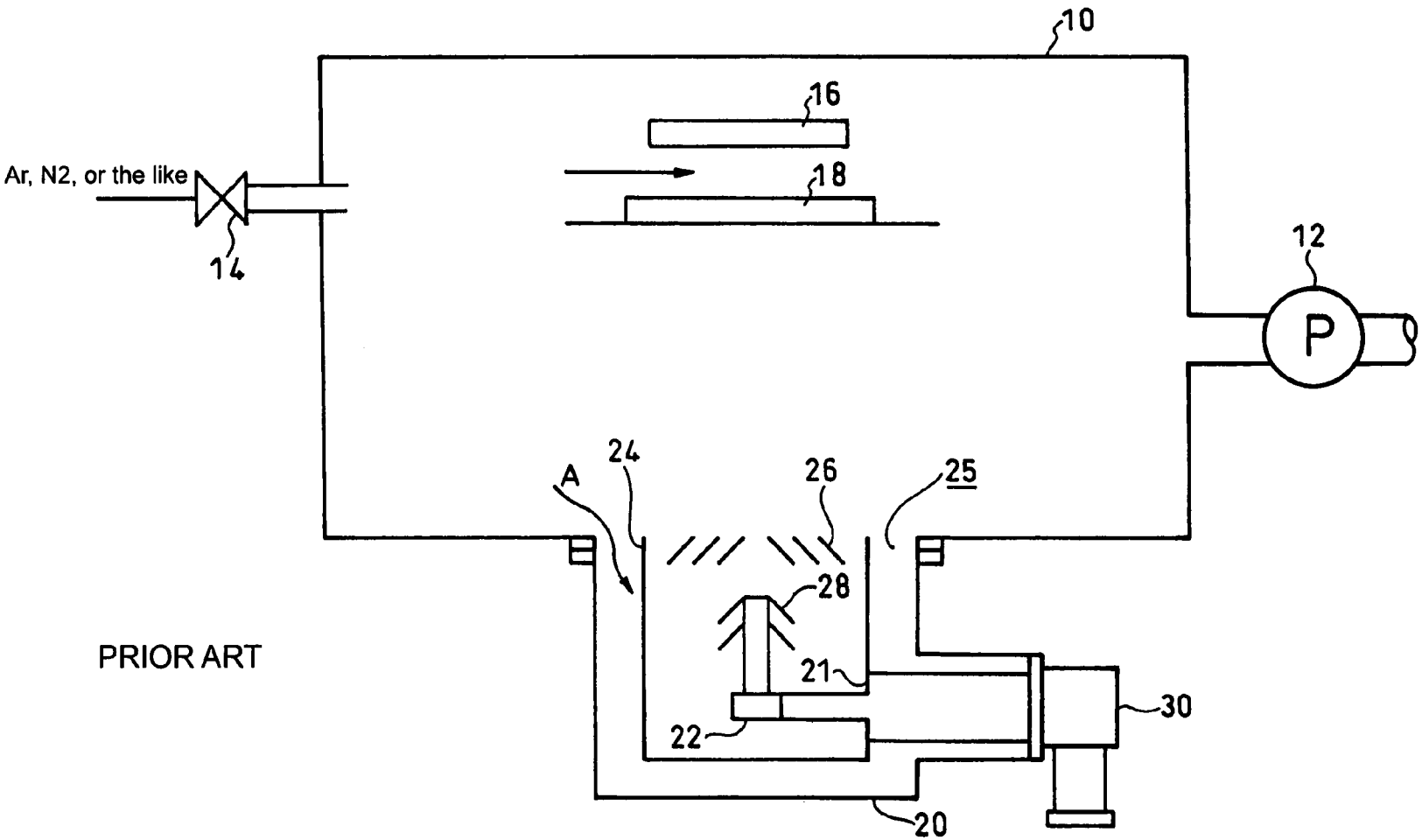
FIG. 1 is a cross-sectional view showing an exemplary structure of a conventional cryo pump arranged in a process chamber.
Figure 2:
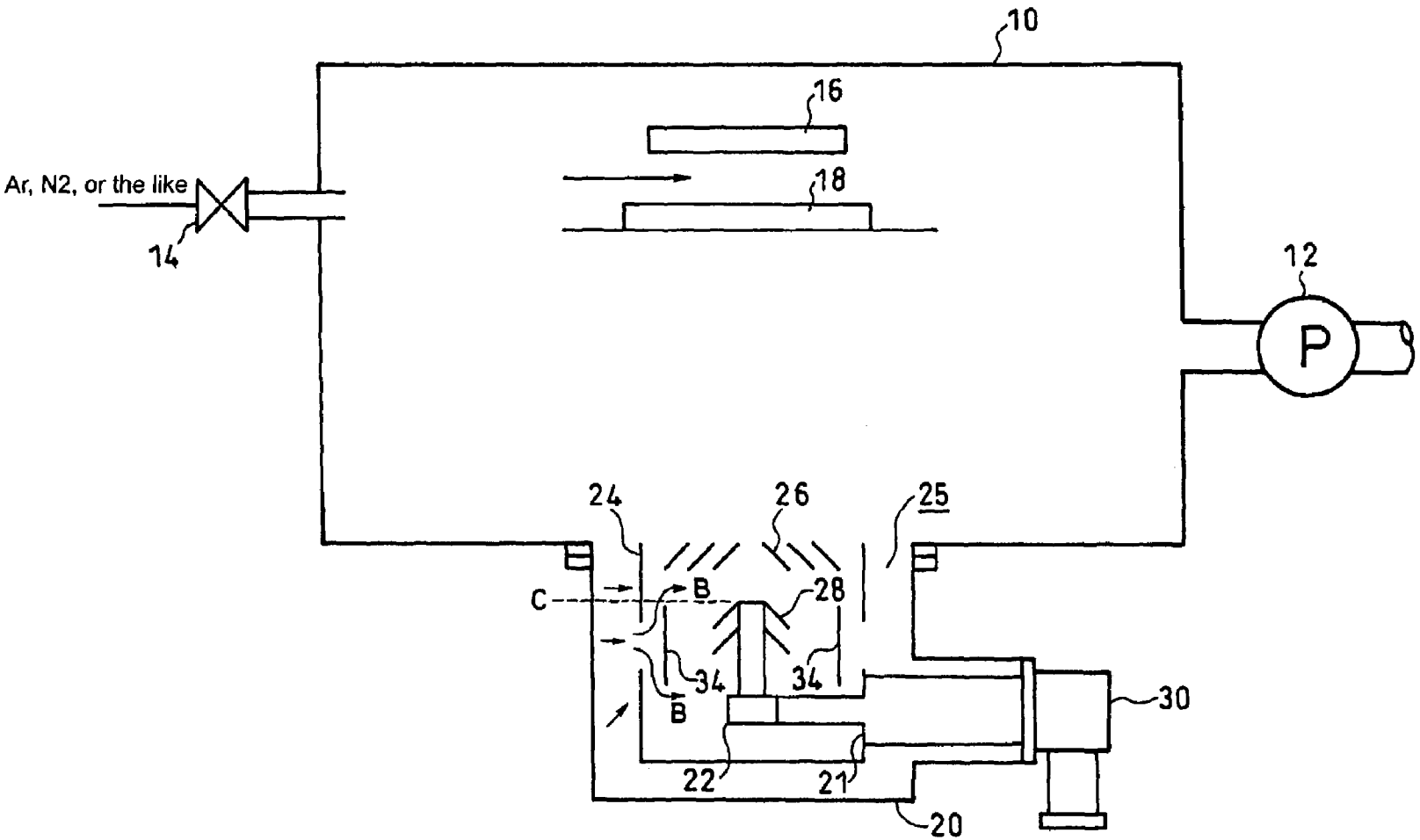
FIG. 2 is a cross-sectional view showing a state in which a cryo pump according to a first embodiment of the present invention is arranged in a process chamber.

As shown in FIG. 2, in a first embodiment of the present invention, a notch for allowing for entrance of gas molecules is provided in a heat shied plate 24 in a cryo pump that is similar to a cryo pump of a conventional example shown in FIG. 1, and an additional shield 34 supported by an additional shield supporting member 32 in a form of a block is provided inside the heat shield plate 24. Thus, the heat shield plate 24 prevents heat radiated from a room-temperature cryo pump chamber and allows gas molecules to enter the inside of the heat shield plate 24, as shown with Arrow B.

Positions of the heat shield 24 and the additional shield 34 with respect to a second-stage panel 28 are the same as such positions that direct rays are prevented from being incident on the second-stage panel 28.

Figure 3:
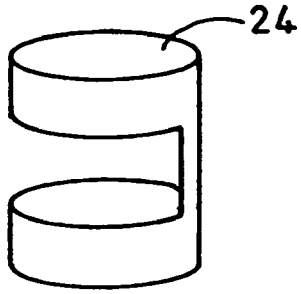
FIG. 3 is a perspective view showing a shape of a heat shield plate used in the first embodiment.

More specifically, as shown in FIG. 3, a portion around a center of the heat shield plate 24 is cut, except for a portion (right portion in FIG. 3) connected to a first stage 21 of a horizontal refrigerator 30. The heat shield plate 24 is cut at a height just below a height (shown with broken line C in FIG. 2) corresponding to the second-stage panel 28 connected to a second stage 22, so that gas molecules can be easily drawn.

Figure 4:
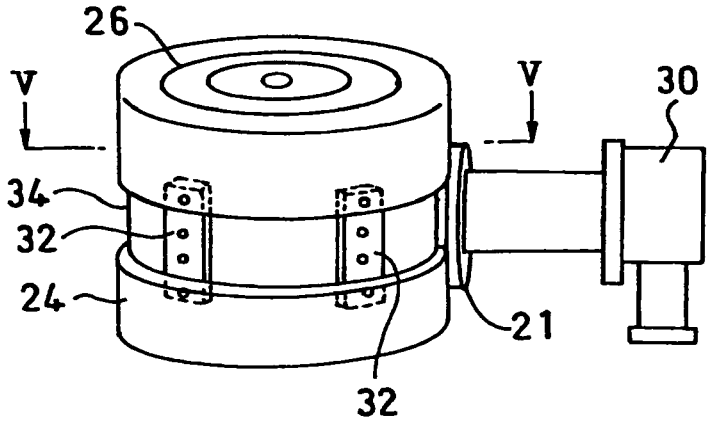
FIG. 4 is a perspective view showing a structure of the heat shield plate.
Figure 5:
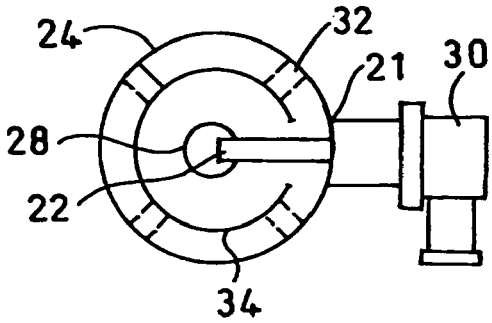
FIG. 5 is a horizontal cross-sectional view, taken along the line V-V in FIG. 4.

Then, the additional shield 34 is formed to have an outer diameter slightly smaller than that of the heat shield plate 24, and is set in the heat shield plate 24 with four additional shield supporting members 32, for example, as shown in FIG. 4. The additional shield 34 has a C-shaped cross section, as shown in FIG. 5, and is formed by cutting a portion corresponding to the refrigerator 30. The additional shield 34 and the additional shield supporting member 32 are formed of copper and are joined to each other by brazing or the like so as to be in close contact in such a manner that they conduct heat well. The heat shield plate 24 and the additional shield 34 are arranged so as to partially overlap each other in a vertical direction at positions at which they can prevent entrance of direct rays, thereby preventing entrance of radiated heat.

In a conventional cryo pump, the heat shield plate 24 can be usually cooled to about 80 K before entering of the process gas. However, after entering of the process gas, a temperature of the heat shield plate 24 increases to about 120 K because of heat transfer. On the other hand, in the case where the heat shield plate 24 and the additional shield 34 according to the first embodiment of the present invention are provided, the heat shield plate 24 can be cooled to about 80 K that is the same as that in a state in which there is no entering process gas.

Since the notch is provided over an entire circumference of the heat shield plate 24 in the present embodiment, a large amount of gas molecules can be directed to the inside of the heat shield plate.

Figure 6:
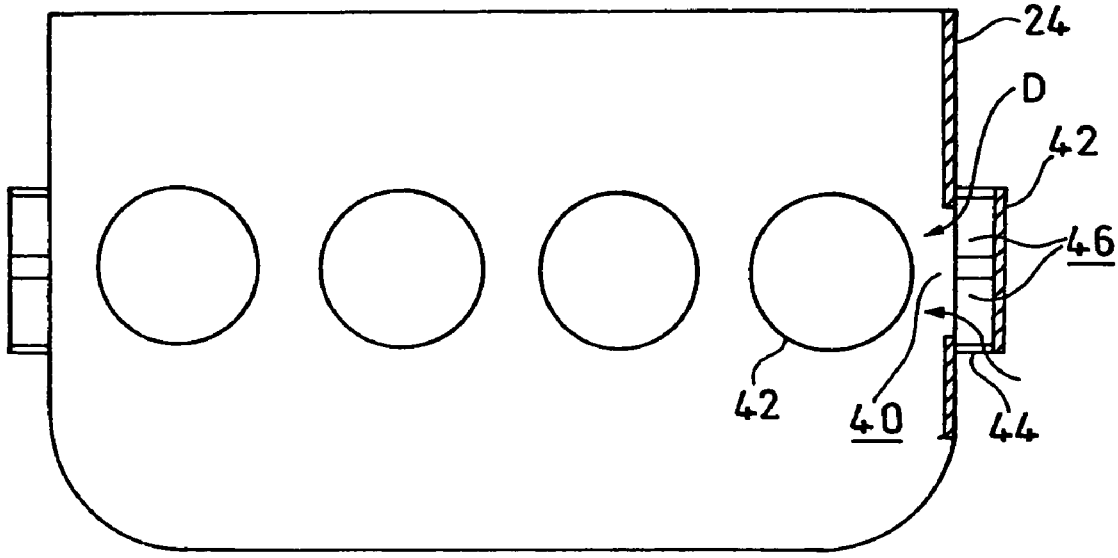
FIG. 6 is a front view showing a main part of a cryo pump according to a second embodiment of the present invention.
Figure 7:
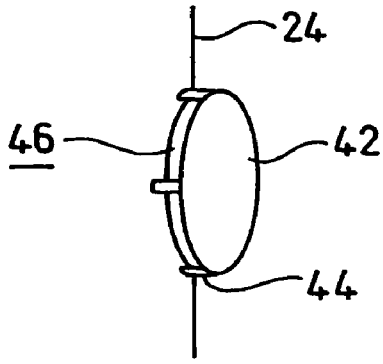
FIG. 7 is a perspective view of the main part of the cryo pump according to the second embodiment.

The structure of the heat shield plate is not limited thereto. As in a second embodiment shown in FIG. 6 (an overall view) and FIG. 7 (a perspective view showing a cover portion), one or more openings 40 may be provided at one or more locations on the circumference of the heat shield plate 24 and a cover 44 for covering a corresponding opening 40 may be provided outside or inside that opening 40 with a supporting member 42, thereby preventing entrance of radiated heat at a position at which entrance of direct rays is prevented and allowing for entrance of gas molecules through an opening 46 on a side face of the cover 44, as shown with Arrow D.

Figure 8:
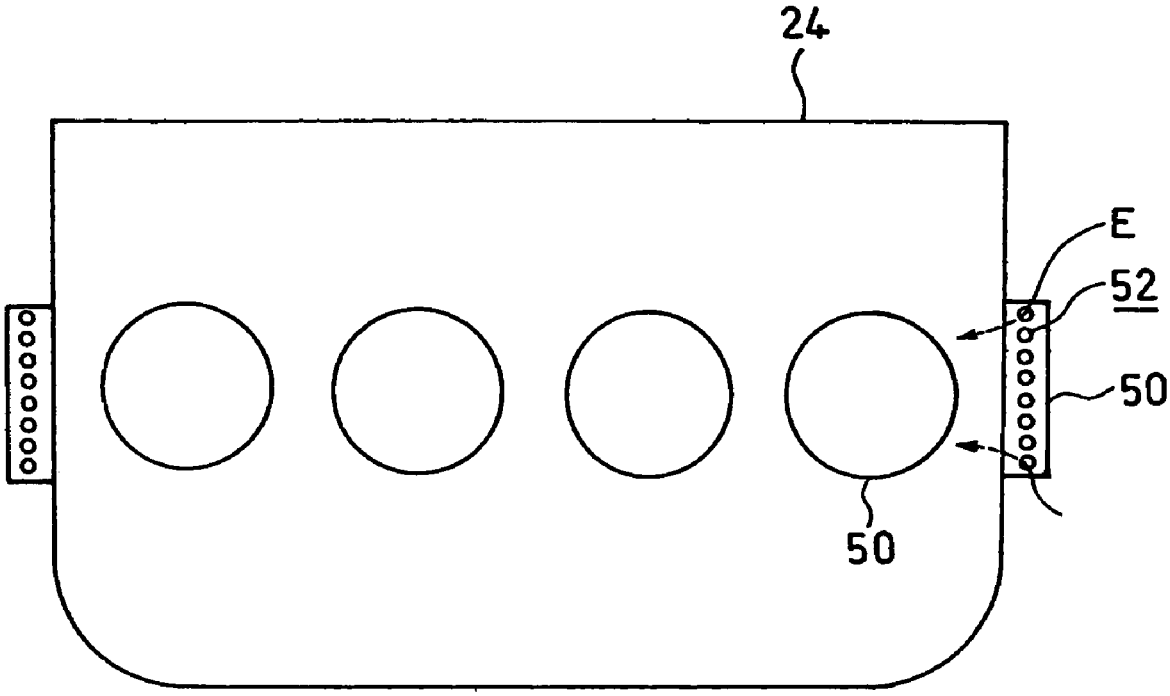
FIG. 8 is a front view showing a main part of a cryo pump according to a third embodiment of the present invention.

Alternatively, as in a third embodiment shown in FIG. 8, a cover 50 having a U-shaped cross section may be used and an opening 52 may be provided on its side face, thereby allowing for entrance of gas molecules through the opening 52, as shown with Arrow E.

Figure 9:
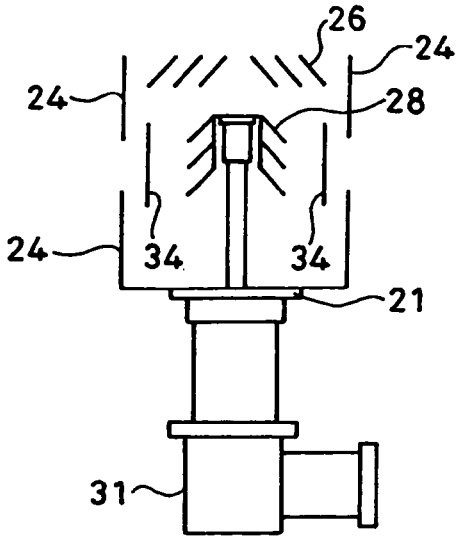
FIG. 9 is a front view showing a main part of a cryo pump according to a fourth embodiment of the present invention.
Figure 10:
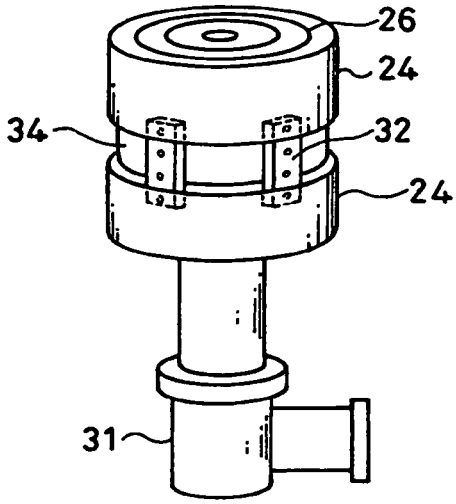
FIG. 10 is a perspective view showing the main part of the cryo pump according to the fourth embodiment.
Figure 11:
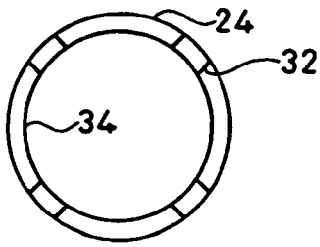
FIG. 11 is a plan view of an additional shield in the fourth embodiment.

In any of the above embodiments, the present invention is applied to a cryo pump including a horizontal refrigerator. However, the present invention can also be applied to a cryo pump including a vertical refrigerator 31, as in a fourth embodiment shown in FIG. 9 (a cross-sectional view showing a cryo pump portion) and FIG. 10 (a perspective view showing the same portion). In this case, it is unnecessary for the additional shield 34 to have a C-shaped cross section. Instead, the additional shield 34 can be tubular, as shown in FIG. 11.

Moreover, in any of the above embodiments, the opening is provided on the side face of the heat shied plate 24. However, a position of the opening is not limited thereto. Alternatively, the opening may be provided at a bottom of the heat shield plate 24. Furthermore, the absorbent contained in the cryo panel 28 is not limited to activated carbon.

INDUSTRIAL APPLICABILITY

The present invention can be applied to not only a sputtering apparatus and a semiconductor manufacturing apparatus but also every equipment that operates a cryo pump in a gas process.

The invention claimed is:

1. A cryo pump including:

a cryogenic refrigerator;

a first-stage panel and a generally cylindrically-shaped heat shield plate that are cooled in a first stage of the cryogenic refrigerator; and a second-stage panel that is surrounded by the heat shield plate, is cooled by a second stage of the cryogenic refrigerator, and has an absorbent, the cryo pump further comprising:

a notch, provided in and extending circumferentially about the heat shield plate, for allowing for entrance of gas molecules; and an additional shield disposed apart from the heat shield plate and adjacent the notch for preventing entrance of heat due to radiation from a room-temperature cryo pump chamber to the second-stage panel, the additional shield being sized relative to the notch such that the gas molecules outside the second-stage panel meander through the notch and around at the additional shield in order to enter into the second- stage panel.

2. The cryo pump according to claim 1, wherein the notch and the additional shield are positioned on the heat shield plate surrounding the second-stage panel therein.

3. The cryo pump according to claim 1 or 2, wherein the additional shield is supported by the heat shield plate via an additional shield supporting member.

4. The cryo pump according to claim 1, wherein the refrigerator is a horizontal type and the additional shield has a C-shaped cross section in which a portion corresponding to the refrigerator is cut.

5. The cryo pump according to claim 1, wherein the additional shield is formed in such a manner that a portion thereof having a C-shaped cross section has a length covering the second-stage panel.

6. The cryo pump according to claim 1, wherein the refrigerator is a horizontal type or a vertical type and the additional shield is tubular.

7. The cryo pump according to claim 1 or 2, wherein the additional shield is a concave or convex portion provided on the heat shield plate, and an opening for allowing for entrance of gas molecules is provided on a side face of the concave or convex portion.

8. sputtering apparatus comprising the cryo pump according to claim 1.

9. A semiconductor manufacturing apparatus comprising the cryo pump according to claim 1.

* * * * *